US005391089A

United States Patent [19]

Quickel et al.

[11] Patent Number: 5,391,089

[45] Date of Patent: Feb. 21, 1995

[54] CAM ACTION ELECTRICAL EDGE CONNECTOR

[75] Inventors: G. Quickel, Salt Lake City; K. Richardson, Herriman, both of Utah

[73] Assignee: Becton, Dickinson and Company, Franklin Lakes, N.J.

[21] Appl. No.: 112,739

[22] Filed: Aug. 26, 1993

[51] Int. Cl.[6] ..... H01R 13/15

[52] U.S. Cl. ..... 439/260; 439/637

[58] Field of Search ..... 439/259, 260, 261, 263, 439/264, 267, 58, 637, 636

[56] References Cited

U.S. PATENT DOCUMENTS

| | | | |
|---|---|---|---|
| 3,329,926 | 7/1967 | Akne et al. | 439/260 |
| 3,474,387 | 10/1969 | Krum et al. | 439/260 |
| 3,912,353 | 10/1975 | Kasuya et al. | 439/260 |
| 4,373,764 | 2/1983 | Ulrich | 439/263 |
| 4,560,222 | 12/1985 | Dambach | 439/260 |
| 4,919,626 | 4/1990 | Anhalt et al. | 439/260 |

*Primary Examiner*—David L. Pirlot
*Assistant Examiner*—Hien D. Vu
*Attorney, Agent, or Firm*—Michael G. Schwarz; Eric M. Lee

[57] ABSTRACT

An electrical connector is disclosed. The connector is made up of first and second housings, one of which is male and the other female. The first housing contains one conductor or two or more opposed conductors. The conductor is made of an elastically deformable and resilient conducting substance. A second housing contains a substrate which carries a conductor in the form of an edge contact pad. The second housing also contains a camming surface or surfaces which interact with the conductor in the first housing. The first and second housings are brought together so that the conductor in the first housing lies opposite the contact pad in the second housing. The housings are then mated. On full mating, the conductor in the first housing is brought into contact with the contact pad in the second housing by the camming surface translates the lateral relative motion of the first and second housings into substantially transverse motion of the conductor in the first housing. The two housings, are held together by a detent so that they will not come apart.

3 Claims, 5 Drawing Sheets

CAM ACTION ELECTRICAL EDGE CONNECTOR

BACKGROUND

This invention lies in the field of connectors for releasably connecting electrical conductors. More specifically it relates to a connector which permits the releasable connection of fine electrical conductors without significantly degrading the surfaces of such conductors by repeated frictional contact between the surfaces of the conductors.

SUMMARY OF THE INVENTION

This invention is an electrical connector preferably for microelectronic applications which permits electrical conductors to be interconnected without one conductor excessively wiping against another. Thus damage of the conductors is minimized when contact between the conductors is made or broken. Excessive wiping is undesirable because it may cause material to be removed from the conductors and their surfaces to be degraded, reducing the service life of the conductors. This is particularly true when very free conductors are used, for example in microelectronic applications.

The present invention comprises a connector having two parts which can be interconnected. Each part carries a set of conductors or as few as one conductor. The conductors of at least one part are resilient. When the two parts are brought together, the conductors of both parts are kept separate from each other until just before electrical contact is to be made. When contact is to be made the conductors which are to be interconnected are automatically brought together by a camming action as a result of the two parts being brought together.

The invention is an electrical connector made up of a first housing and a second housing. The first housing has a first axis and the second housing has a second axis. The housings are adapted to mate with each other by alignment of the second axis with the first axis and movement of the first and second housings towards each other along the first axis. A first elastically deformable conductor is mounted in the first housing offset from the first axis such that the first conductor is capable of deflection in a direction substantially transverse to the first axis. A second conductor mounted in the second housing. A camming means is mounted on the second housing for interacting with the first conductor on mating of the first and second housings. The camming means is designed to deflect the first conductor in the direction substantially transverse to the axis, thereby forcing the first conductor into electrical contact with the second conductor once the first housing and the second housing are fully mated.

To this end the invention comprises a first housing containing one conductor or two or more opposed conductors. For the sake of clarity, the invention will be described by reference to a housing containing one conductor. The conductor is made of an elastically deformable and resilient conducting substance. A second housing contains a substrate which carries a conductor in the form of an edge contact pad. The second housing also contains a camming surface or surfaces which interact with the conductor in the first housing. The first and second housings are brought together so that the conductor in the first housing lies opposite the contact pad in the second housing. The housings are then mated. On full mating, the conductor in the first housing is brought into contact with the contact pad in the second housing by the camming surface translates the lateral relative motion of the first and second housings into substantially transverse motion of the conductor in the first housing. The two housings, are held together by a detent so that they will not come apart.

DETAILED DESCRIPTION

The preferred embodiment described is a connector for joining four conductors (two in each housing). The invention includes embodiments for joining as few as two conductors (one in each housing) or several conductors (many in each housing) which will be readily made by persons of ordinary skill in the art by reference to this description.

Figure 1:
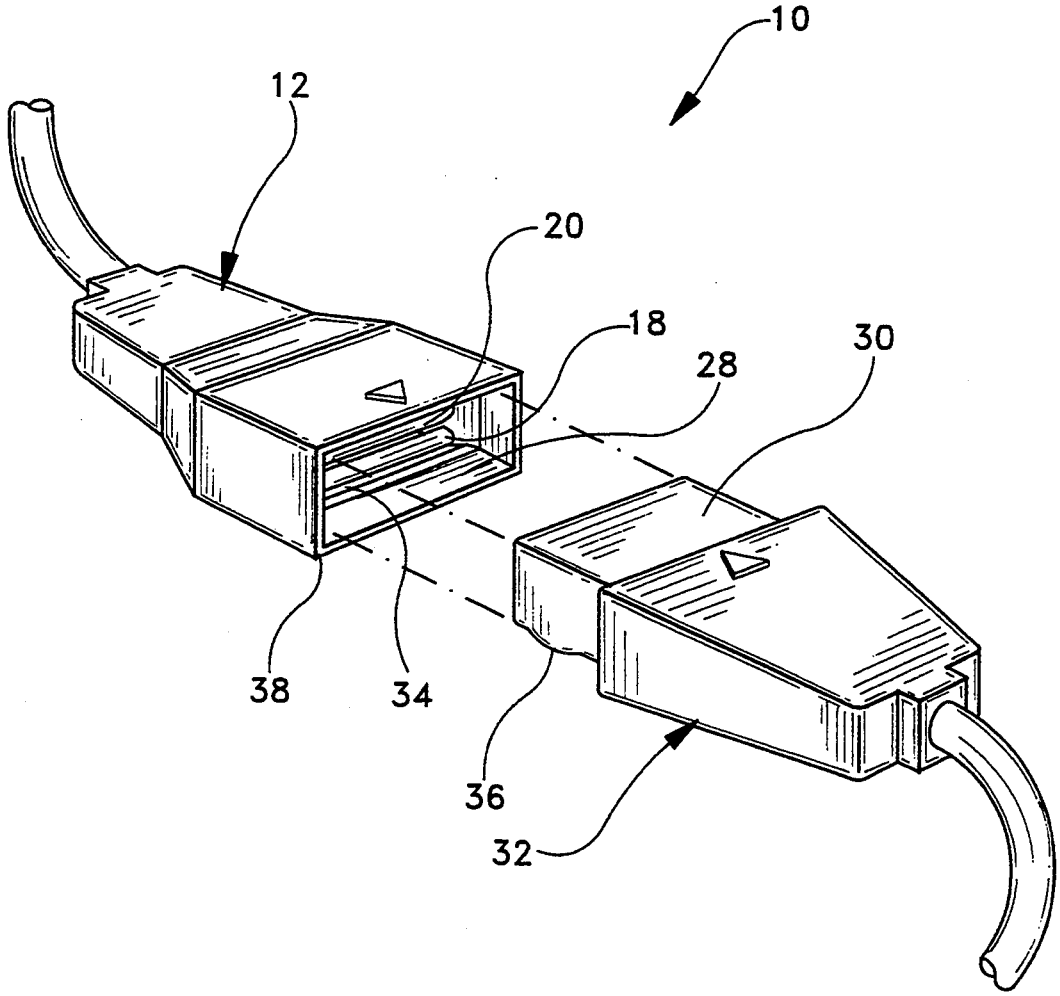
FIG. 1 is a perspective view of a first embodiment of the invention in its unmated state.
Figure 2:
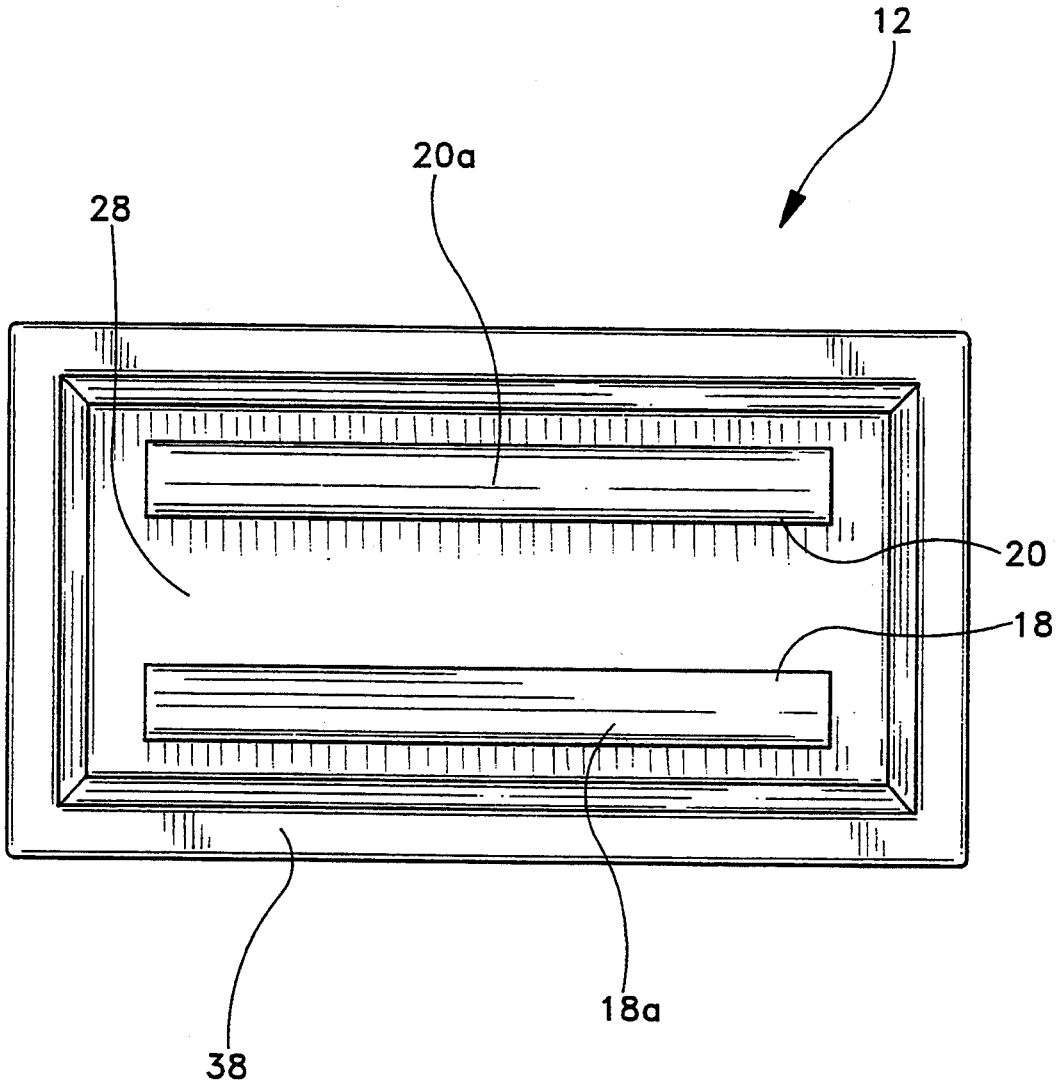
FIG. 2 is an end elevation view of the face of the female housing of the invention.

A preferred embodiment of the invention, connector 10, is shown in its unmated state in FIG. 1. First housing 12 holds conductors 14 and 16 which are substantially parallel copper plates preferably having a thickness of 0.125 mm and width of 0.9 mm; however, the contact width can be determined by the number of contacts within the catheter. Conductors 14 and 16 each have ends 18 and 20 (see FIG. 2) which are bent inward to facilitate resilient contact with contact pads 24 and 26. First (female) housing 12 has a cavity 28 with which protrusion 30 of second (male) housing 32 can mate. Conductors 14 and 16 are fixed in a cantilevered mariner in first housing 12 so that they protrude into cavity 28 and are capable of deflection in a direction substantially transverse to axis A–A′, the axis of first housing 12. Cavity 28 overlaps conductors 14 and 16 so that they are protected from inadvertent contact with outside objects. Conductors 14 and 16 are equally spaced on each side of axis A–A′.

Cavity 28 is also provided with detent 34 which meshes with bump 36 on protrusion 30 of second housing 32. The open end of first housing 12 is internally beveled for ease of insertion of protrusion 30.

Second housing 32 has a second axis, shown for clarity as identical to axis A–A′ due to the alignment of first housing 12 and second housing 32. Second housing 32 houses substrate 40, a dielectric held rigidly in place by retainer 42. Substrate 40 carries conductor pads 24 and 26. Second housing 32 also has a cavity 44 in which substrate 40 resides so that substrate 40 is protected. Within cavity 44, on the inside of walls 46 are camming surfaces 48. The purpose of camming surfaces 48 is to bring about contact between conductors 14, 16 and contact pads 24, 26 as will be described.

Figure 3:
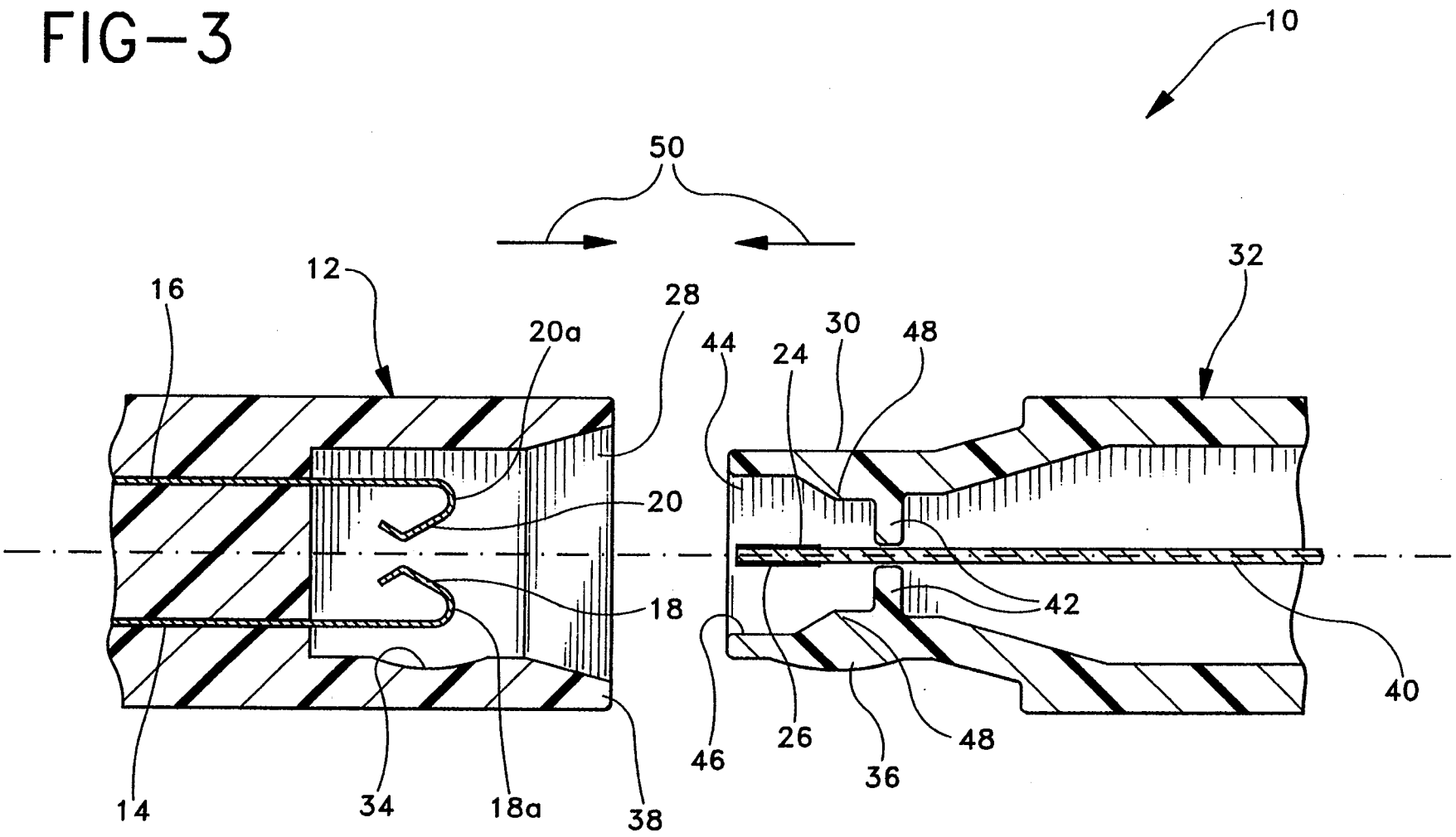
FIG. 3 is a cross-sectional view of a first embodiment the invention in its unmated state.
Figure 4:
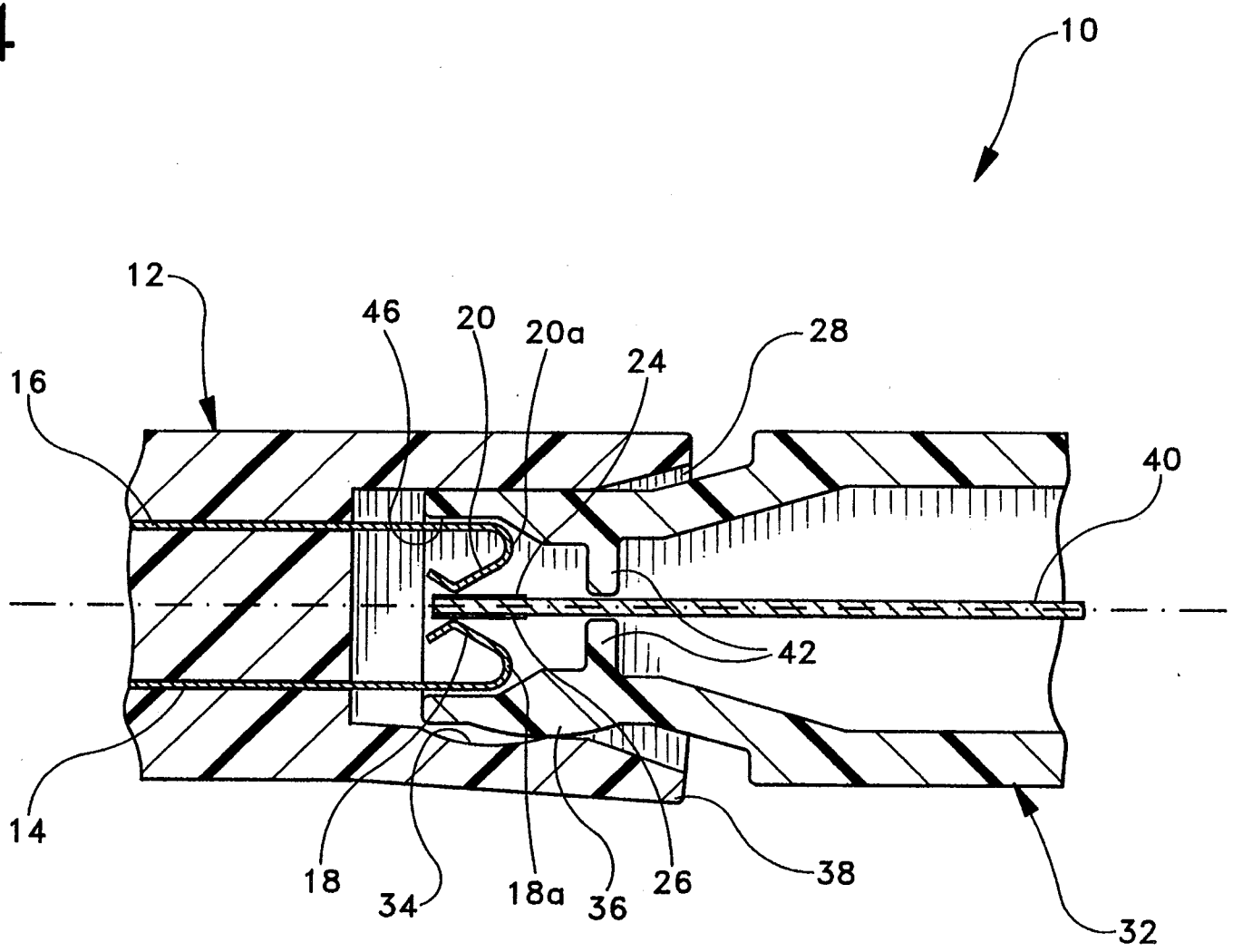
FIG. 4 is a cross-sectional view of the first embodiment of the invention in its partially mated state.
Figure 5:
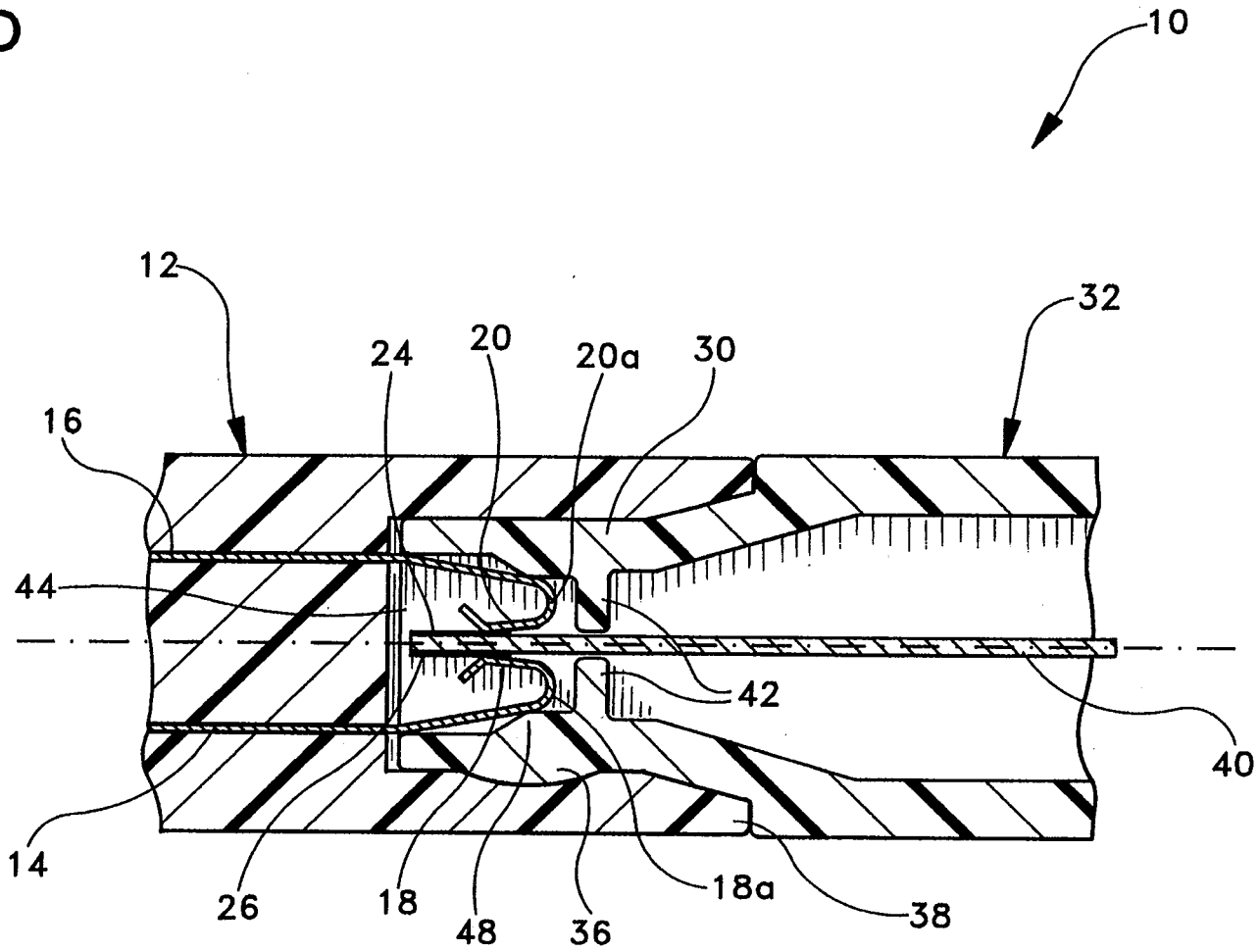
FIG. 5 is a cross-sectional view of the first embodiment of the invention in its fully mated state.

The process of interconnecting first housing 12 with second housing 32 can be seen in FIGS. 3 through five. First and second housings 12 and 32 are aligned along axis A–A′ so that substrate 40 is generally collinear with axis A–A′ as shown in FIGS. 3 through 5. In FIG. 4, protrusion 30 has been inserted into cavity 28, but protrusion 30 is not fully within cavity 28. Ends 18*a* and 20*a* of conductors 14 and 16 have made contact with front faces 48*a* of camming surfaces 48. Contact points 18*b* and 20*b* have not yet made contact with contact pads 24 and 26. Bump 36 is not yet in detent 34.

First and second housings 12, 32 are then brought together by lateral movement of the housings in the direction shown by arrows 50. On mating of housings 12 and 32, camming surfaces 48 interact with conductors 18 and 20. On further mating of housings 12 and 32, camming surfaces 48 force conductors 12 and 20 into electrical contact with contact pads 24 and 26. FIG. 5 shows first housing 12 and second housing 32 fully mated with electrical contact made between conductors 14, 16 and contact pads 24, 26. As can be seen in FIG. 5, chroming surfaces 48 have pushed ends 18*a* and 20*a* in towards substrate 40 so that contact points 18*b* and 20*b* have contacted contact pads 24 and 26. Thus, the lateral motion of the housings 12, 32 is translated into transverse motion of conductors 14, 16 so that conductors 14, 16 are transversely deflected and make contact with contact pads 24, 26. Bump 36 and detent 34 also mate so that first housing 12 and second housing 32 are firmly held together and the resilience of conductors 14, 16 will not force first housing 12 and second housing 32 apart.

Housings 12 and 32 can be separated and contact between conductors 14, 16 and contact pads 24, 26 broken by simply pulling first housing 12 and second housing 32 apart against the force of bump 36 and detent 34.

While this invention is satisfied by embodiments in many different forms, a preferred embodiment of the invention is shown in the drawings and is described in detail, with the understanding that the present disclosure is to be considered as exemplary of the principles of the invention and is not intended to limit the invention to the embodiment illustrated. The scope of the invention will be measured by the appended claims and their equivalents.

We claim:

1. An electrical connector, comprising:

a fist housing with a first longitudinal axis and a first cavity, having an open mouth with beveled edges, at least one wall of the cavity having a cut out portion therein;

a first conductor having a fixed end and a free end mounted in the first cavity offset from the first longitudinal axis, the free end of the first conductor being reversely bent so as to have an arm that extends toward the fixed end and the first longitudinal axis;

a second housing having a proximal end and a distal end with a second longitudinal axis and a second cavity with a second open mouth formed therein at the distal end, the second housing being adapted to fit at least partially into the first cavity and having a detent portion adapted to fit into the cut-out in the wall of the first cavity;

a second conductor mounted in the second cavity adjacent to the second open mouth; and the second cavity defining a camming surface with a proximal end and a distal end substantially radially aligned with a proximal portion of the second conductor and extending at an angle to the second longitudinal axis with the proximal end closer to the longitudinal axis than the distal end so that when the first housing is mated with the second housing the arm of the free end of the first conductor is urged into contact by the camming surface with the second conductor only after the free end of the first conductor is substantially radially aligned with the second conductor.

2. The electrical conductor of claim 1 wherein the first conductor is formed from copper.

3. The electrical conductor of claim 1 wherein the second conductor is a dielectric.

* * * * *